US011411329B2

(12) United States Patent
Yokotani

(10) Patent No.: US 11,411,329 B2
(45) Date of Patent: Aug. 9, 2022

(54) CAP WITH A PROTECTION WALL

(71) Applicant: SUMITOMO WIRING SYSTEMS, LTD., Mie (JP)

(72) Inventor: Koichi Yokotani, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/973,109

(22) PCT Filed: May 29, 2019

(86) PCT No.: PCT/JP2019/021288
§ 371 (c)(1),
(2) Date: Dec. 8, 2020

(87) PCT Pub. No.: WO2019/244588
PCT Pub. Date: Dec. 26, 2019

(65) Prior Publication Data

US 2021/0242611 A1 Aug. 5, 2021

(30) Foreign Application Priority Data

Jun. 19, 2018 (JP) ..... JP2018-115870

(51) Int. Cl.
*H01R 9/22* (2006.01)
*H01R 4/70* (2006.01)
(Continued)

(52) U.S. Cl.
CPC ..... *H01R 9/223* (2013.01); *H01R 4/70* (2013.01); *H01R 13/5213* (2013.01); *H01R 4/38* (2013.01)

(58) Field of Classification Search
CPC ..... H01R 9/223; H01R 13/5213; H01R 4/70; H01R 4/38; H01R 2105/00; H01R 13/44; H01R 4/307; H01R 4/308; H01R 4/36
See application file for complete search history.

(56) References Cited

U.S. PATENT DOCUMENTS 6,491,544 B1 * 12/2002 Lias ..... H01R 9/2408 439/507
6,666,706 B1 * 12/2003 Jones ..... H01R 13/506 439/353
(Continued)

FOREIGN PATENT DOCUMENTS

JP 2009-070776 A 4/2009
JP 2015-095384 A 5/2015
(Continued)

OTHER PUBLICATIONS

International Search Report dated Aug. 27, 2019 for WO 2019/244588 A1 (2 pages).

*Primary Examiner* — Travis S Chambers
(74) *Attorney, Agent, or Firm* — Venjuris, P.C.

(57) ABSTRACT

A cap (50) is mounted on a housing (22) for accommodating a device-side terminal connected to equipment and a wire-side terminal connected to a wire, the housing (22) being formed with a second opening (228) for exposing a connected part of the device-side terminal and the wire-side terminal, and is provided with a cap body (51) for closing the second opening (228) of the housing (22), locking portions (52) to be locked to outer side surfaces of the housing (22), and protection walls (53) for covering the locking portions (52) while being spaced apart from the locking portions (52).

6 Claims, 5 Drawing Sheets

(51) Int. Cl.
*H01R 13/52* (2006.01)
*H01R 4/38* (2006.01)

(56) References Cited

U.S. PATENT DOCUMENTS 7,172,468 B2 * 2/2007 Nishide ..... H01R 13/641 439/701
7,182,626 B2 * 2/2007 Langolf ..... H01R 13/506 439/473
7,189,922 B1 * 3/2007 Rose ..... H01R 13/5213 174/138 F
7,278,869 B1 * 10/2007 Bernhart ..... H01R 13/518 439/310
7,445,454 B2 * 11/2008 Szu ..... H01R 43/00 439/41
7,465,185 B2 * 12/2008 Tyler ..... H01R 13/506 439/352
7,572,150 B2 * 8/2009 Matsuoka ..... H01R 13/4223 439/626
8,529,275 B2 * 9/2013 Kagotani ..... H01R 43/205 439/41
8,545,265 B2 * 10/2013 Sakamoto ..... B29C 45/14467 439/606
9,071,023 B2 * 6/2015 Kondo ..... H01R 9/18
10,320,129 B2 * 6/2019 Ramunno ..... H01R 13/688
2014/0342595 A1 * 11/2014 Wu ..... H01R 9/2416 439/456
2018/0076575 A1 * 3/2018 Ramunno ..... H01R 11/287

FOREIGN PATENT DOCUMENTS

JP 2016-115411 A 6/2016
JP 2017-188322 A 10/2017
WO 2017/034013 A1 3/2017

* cited by examiner

CAP WITH A PROTECTION WALL

CROSS REFERENCE TO RELATED APPLICATIONS

This application is a national phase of PCT application No. PCT/JP2019/021288, filed on 29 May 2019, which claims priority from Japanese patent application No. 2018-115870, filed on 19 Jun. 2018, all of which are incorporated herein by reference.

TECHNICAL FIELD

The present invention relates to a cap to be mounted on a housing accommodating a terminal fitting.

BACKGROUND

Patent Document 1 describes a terminal block module with a terminal block and a shield shell for covering the terminal block. In the terminal block module, the terminal block includes one or more terminals, and a housing for accommodating the terminals, the housing being formed with a first opening and a second opening. The first opening is an opening into which a power supply side connector is inserted, and is closed by inserting the power supply side connector. On the other hand, the second opening is a service hole for performing an operation of connecting terminals of the power supply side connector to the terminals of the terminal block, and closed by mounting the cap on the housing.

PRIOR ART DOCUMENT

Patent Document

Patent Document 1: JP 2015-095384 A

SUMMARY OF THE INVENTION

Problems to be Solved

In the terminal block module as described above, the cap includes a locking portion to be locked to the housing, for example, by resilient deformation. Thus, the cap is preferably configured not to be removed from the housing even when an unexpended load acts on the locking portion. The present invention aims to provide a cap capable of suppressing unexpected removal from the housing.

Means to Solve the Problem

A cap solving the above problem is a cap to be mounted on a housing for accommodating a device-side terminal connected to equipment and a wire-side terminal connected to a wire, the housing being formed with an opening for exposing a connected part of the device-side terminal and the wire-side terminal, and is provided with a cap body for closing the opening of the housing, a locking portion to be locked to an outer side surface of the housing, and a protection wall for covering the locking portion while being spaced apart from the locking portion.

Since the cap of the above configuration is provided with the protection wall for covering the locking portion, a worker's hand, a tool and the like are less likely to touch the locking portion. Thus, unexpected removal of the cap from the housing is suppressed.

In the above cap, preferably, the cap body includes an extending portion extending in a direction intersecting a mounting direction of the cap on the housing and the locking portion and the protection wall extend from the extending portion.

Since the cap of the above configuration is such that a base end of the locking portion and a base end of the protection wall are only connected via the extending portion, an external force acting on the protection wall is less likely to be transmitted to the locking portion. Thus, it is suppressed that the cap is removed from the housing as a result of a displacement of the locking portion due to the external force acting on the protection wall.

In the above cap, the extending portion is preferably formed with a through hole communicating with a space between the locking portion and the protection wall.

According to the above configuration, the worker can apply an external force to the locking portion via the through hole. That is, it is suppressed that the cap cannot be removed from the housing while suppressing unexpected removable of the cap from the housing.

In the above cap, the protection wall is preferably provided with a reinforcing rib.

The cap of the above configuration can enhance the strength of the protection wall.

Effect of the Invention

According to the cap of the present invention, it is possible to suppress unexpected removal from the housing.

DETAILED DESCRIPTION TO EXECUTE THE INVENTION

Hereinafter, one embodiment of a connection device with a cap is described. The connection device of this embodiment is a device for connecting a wire extending from a power supply device such as a battery or inverter to equipment such as a motor.

Figure 1:
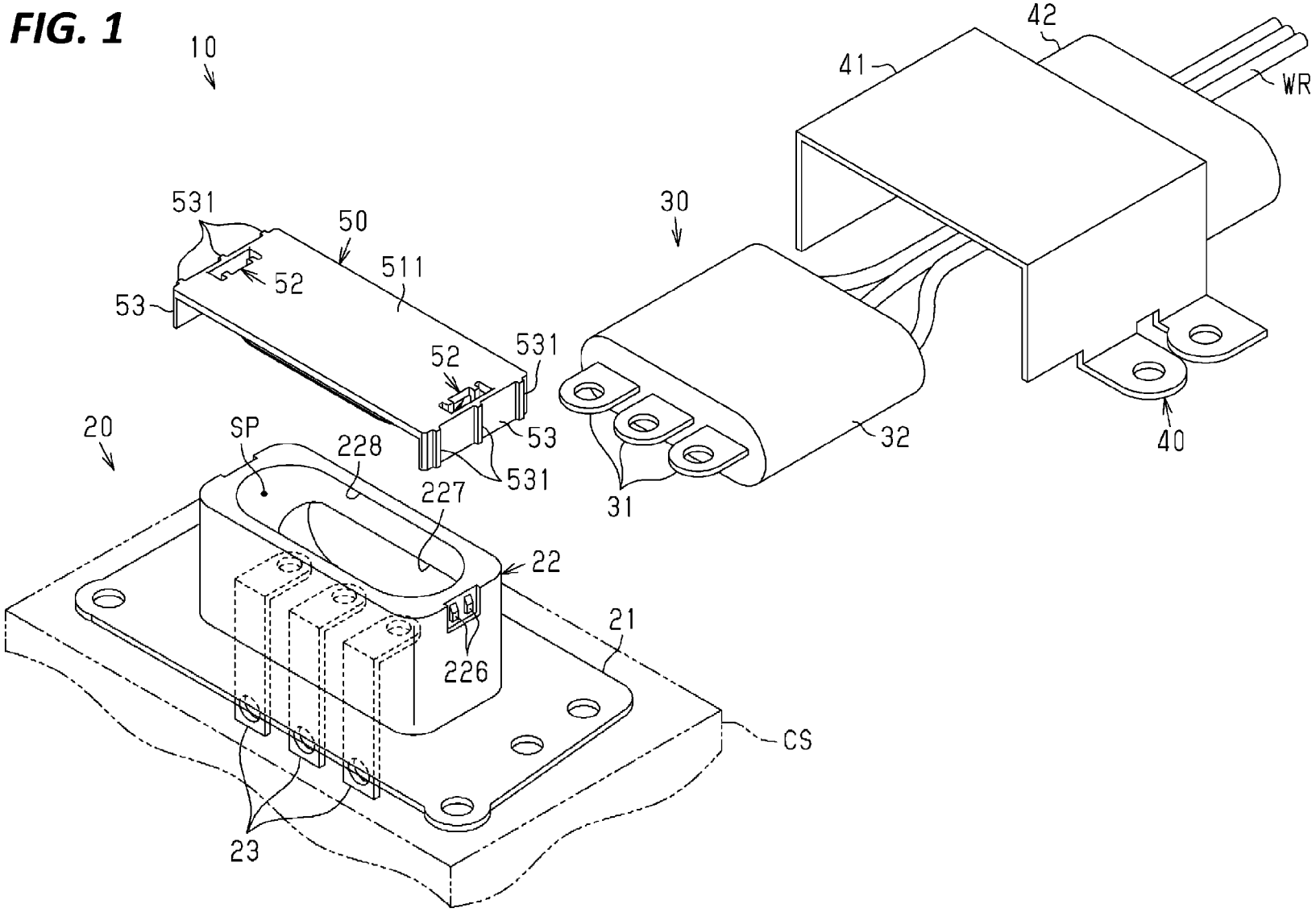
FIG. 1 is an exploded perspective view of a connection device in one embodiment.

As shown in FIG. 1, the connection device 10 includes a terminal block 20 to be fixed to a case CS of the equipment, a connector 30 provided on end parts of wires WR extending from a power supply device, a shield shell 40 for shielding electromagnetic noise, and a cap 50 to be mounted on the terminal block 20.

As shown in FIG. 1, the terminal block 20 includes a base plate 21 to be fixed to the case CS of the equipment, a housing 22 integrally formed to the base plate 21 and device-side terminals 23 to be connected to the equipment.

The base plate 21 is a plate-like member made of metal. The base plate 21 is preferably formed into a shape corresponding to the outer shape of the case CS of the equipment as a fixing destination.

Figure 2:
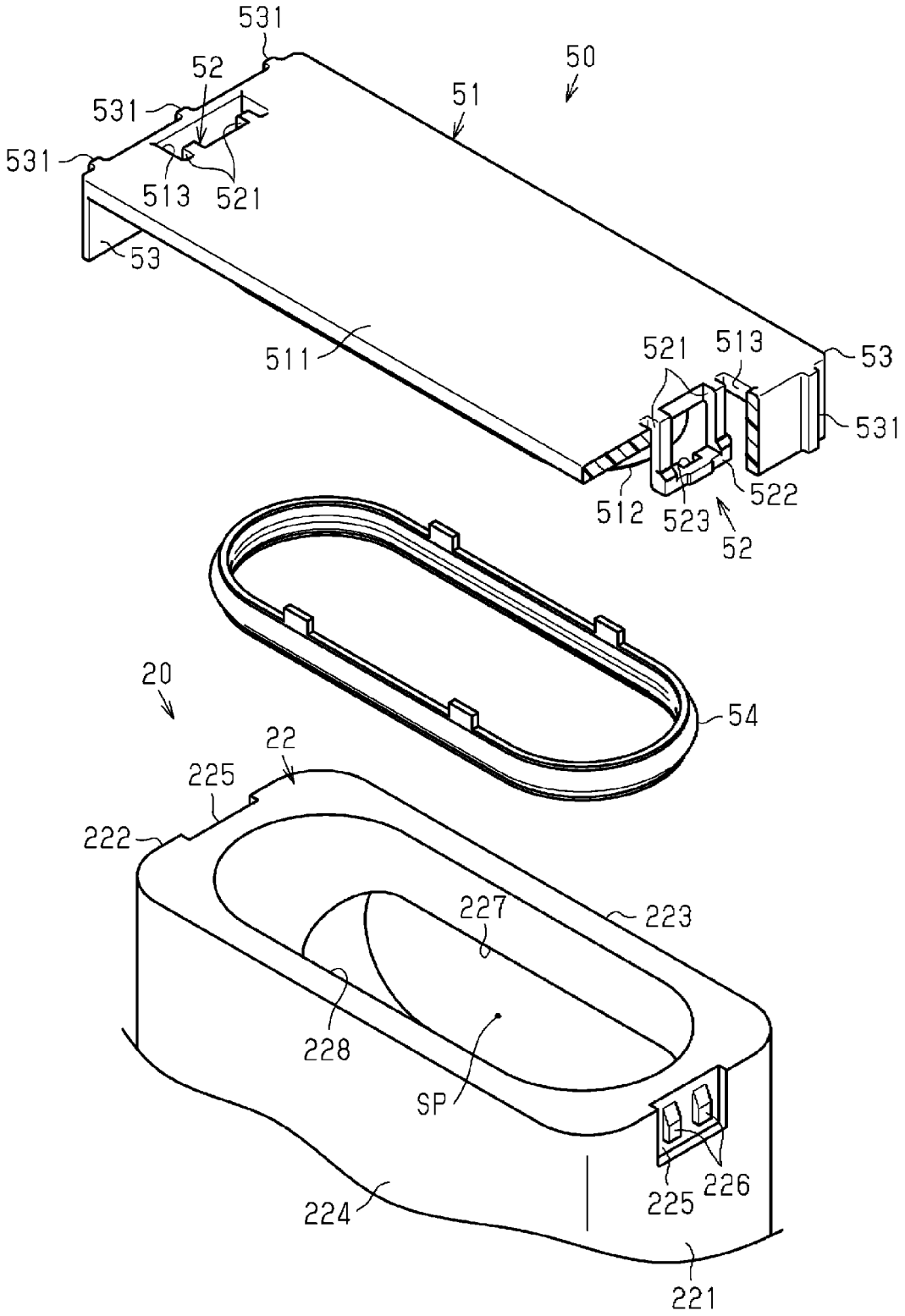
FIG. 2 is an exploded perspective view of a terminal block and a cap with a partial configuration shown in section.

As shown in FIGS. 1 and 2, the housing 22 includes a first wall portion 221, a second wall portion 222, a third wall portion 223 and a fourth wall portion 224 extending from the base plate 21. The first, second, third and fourth wall portions 221, 222, 223 and 224 are in the form of flat plates and coupled to each other. In the housing 22, the first and second wall portions 221, 222 are facing each other, and the third and fourth wall portions 223, 224 are facing each other. In the following description, a space enclosed by the first, second, third and fourth wall portions 221, 222, 223 and 224 is also referred to as an "accommodation space SP". Connected parts of the device-side terminals 23 and wire-side terminals 31 to be described later are accommodated into the accommodation space SP of the housing 22.

As shown in FIG. 2, recesses 225 having a rectangular shape in a front view are formed in the outer side surfaces of the first and second wall portions 221, 222. A plurality of (two) projections 226 are formed at an interval in a facing direction of the third and fourth wall portions 223, 224 in the recess 225.

The housing 22 is formed with a first opening 227 and a second opening 228. The first opening 227 is a hole formed to penetrate in a thickness direction of the third wall portion 223, and the second opening 228 is a hole surrounded around by the tips of the first, second, third and fourth wall portions 221, 222, 223 and 224. The first opening 227 is formed to insert the connector 30 into the housing 22. On the other hand, the second opening 228 is formed to pass a tool at the time of an operation of connecting the device-side terminals 23 of the terminal block 20 and the wire-side terminals 31 of the connector 30. That is, the second opening 228 is a service hole and an "opening" for exposing the connected parts of the device-side terminals 23 and the wire-side terminals 31.

The device-side terminal 23 is a plate-like member formed of metal such as copper. As shown in FIG. 1, one end of the device-side terminal 23 extends straight from the back surface of the base plate 21 and the other end thereof is bent after extending straight from the front surface of the base plate 21. That is, the other end of the device-side terminal 23 is arranged in the accommodation space SP.

As shown in FIG. 1, the connector 30 includes a protecting portion 32 for protecting connected parts of the wire-side terminals 31 and the wires WR in addition to the wire-side terminals 31 connected to the wires WR. Similarly to the device-side terminal 23, the wire-side terminal 31 is a plate-like member formed of metal such as copper. One end of the wire-side terminal 31 extends from the protecting portion 32 and the other end thereof is connected to the wire WR inside the protecting portion 32. The protecting portion 32 is shaped to correspond to the first opening 227 of the housing 22.

The shield shell 40 is formed of a metal material or the like. As shown in FIG. 1, the shield shell 40 includes a first shell 41 for covering the housing 22 and a second shell 42 for covering the connector 30. The first shell 41 is box-shaped and a part thereof corresponding to the fourth wall portion 224 of the housing 22 is open. The second shell 42 is tubular and extends from the first shell 41. The shield shell 40 is fixed to the case CS of the equipment together with the base plate 21 of the terminal block 20 by fastening members such as bolts.

Next, the cap 50 is described.

Figure 3A:
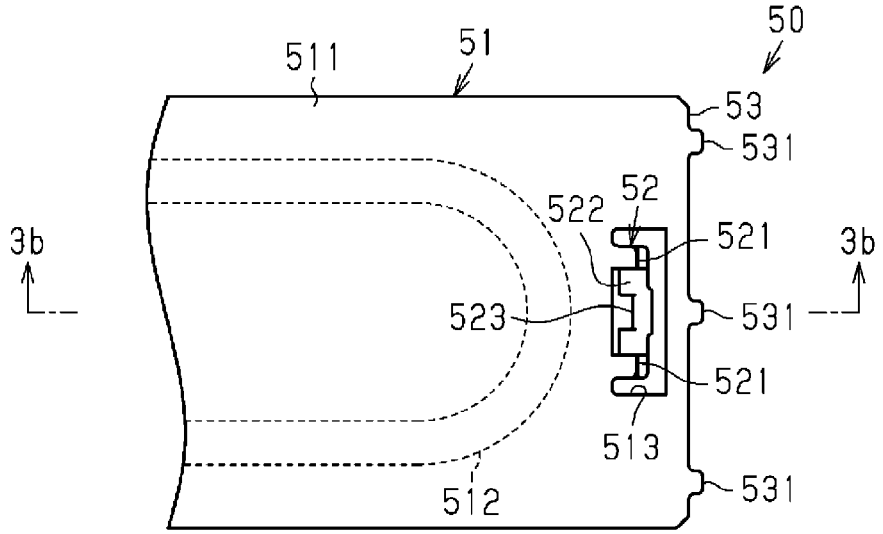
FIG. 3A is a plan view of the cap and FIG. 3B is a section along 3*b*-3*b*.
Figure 3B:
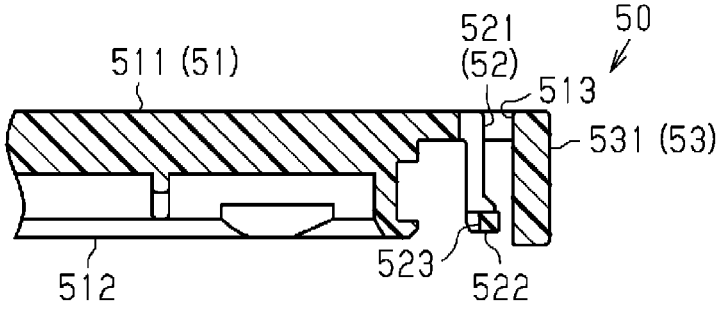

As shown in FIGS. 2, 3A and 3B, the cap 50 includes a cap body 51 for closing the second opening 228 of the housing 22, locking portions 52 to be locked to the projections 226 of the housing 22, protection walls 53 for protecting the locking portions 52 and a sealing member 54 to be mounted on the cap body 51. The cap 50 is integrally formed of a resilient material such as resin, except the sealing member 54.

The cap body 51 includes an extending portion 511 in the form of a rectangular plate and a peripheral wall 512 extending in a direction intersecting the extending portion 511 from the back surface of the extending portion 511. The extending portion 511 is a part for covering the second opening 228 of the housing 22 and formed into a shape larger than the housing 22 in a plan view. Through holes 513 communicating with spaces between the locking portions 52 and the protection walls 53 are formed on opposite end parts in a longitudinal direction of the extending portion 511. As shown in FIGS. 3A and 3B, the through hole 513 exposes the locking portion 52 to the front surface side of the extending portion 511 in a plan view of the cap 50. As shown in FIG. 3A, the peripheral wall 512 is in the form of an oval frame in a plan view. The peripheral wall 512 is inserted into the second opening 228 of the housing 22. That is, in this embodiment, an extending direction of the peripheral wall 512 is a mounting direction and a removing direction of the cap 50 on and from the housing 22.

The locking portions 52 extend from the back surface of the extending portion 511 on the opposite end parts in the longitudinal direction of the extending portion 511. The locking portion 52 includes a pair of projecting pieces 521 extending in a thickness direction of the extending portion 511 and a coupling portion 522 coupling the tips of the pair of projecting pieces 521. Further, a recessed groove 523 is formed in a surface facing the peripheral wall 512 in a central part in the longitudinal direction of the coupling portion 522. As shown in FIG. 3A, in a plan view of the cap 50, the recessed groove 523 is exposed through the through hole 513. In this embodiment, the pairs of projecting pieces 521 are resiliently deformed and the coupling portions 522 are locked to the projections 226 of the housing 22, whereby the cap 50 is mounted on the housing 22. That is, the locking portions 52 of the cap 50 and the projections 226 of the housing 22 constitute a so-called snap-fit structure.

The protection walls 53 extend from the back surface of the extending portion 511 on the opposite end parts in the longitudinal direction of the extending portion 511. The protection wall 53 is in the form of a rectangular plate and has such a size as to completely conceal the locking portion 52 in a front view. Each protection wall 53 is provided with one or more reinforcing ribs 531 extending from a base end toward a tip. The reinforcing ribs 531 are provided for the purpose of enhancing the rigidity of the protection wall 53.

As shown in FIGS. 3A and 3B, if the peripheral wall 512 is formed inwardly of the locking portions 52 in a longitudinal direction of the cap 50, the protection walls 53 are formed outwardly of the locking portions 52. Further, the protection walls 53 are so arranged that spaces are defined between the locking portions 52 and the protection walls 53. The spaces are set to have such a size that the locking portions 52 are resiliently deformable without touching the protection walls 53 when the cap 50 is mounted on the housing 22 or when the cap 50 is removed from the housing 22. On the other hand, the spaces are preferably not excessively large to prevent easy access of a worker's hand and the like to the locking portions 52.

The sealing member 54 is made of elastomer such as rubber or resin. The sealing member 54 is a so-called O-ring. The sealing member 54 is mounted on the outer peripheral surface of the cap body 51 or, more strictly speaking, on the outer peripheral surface of the peripheral wall 512.

Next, a procedure of mounting the connector 30 into the terminal block 20 fixed to the case CS of the equipment is described.

As shown in FIG. 1, the worker inserts the connector 30 into the first opening 227 of the terminal block 20. Subsequently, the worker fastens the device-side terminals 23 of the terminal block 20 and the wire-side terminals 31 of the connector 30 by fastening members such as screws. At this time, the worker inserts a tool for fastening through the second opening 228 to fasten the device-side terminals 23 and the wire-side terminals 31.

Figure 4:
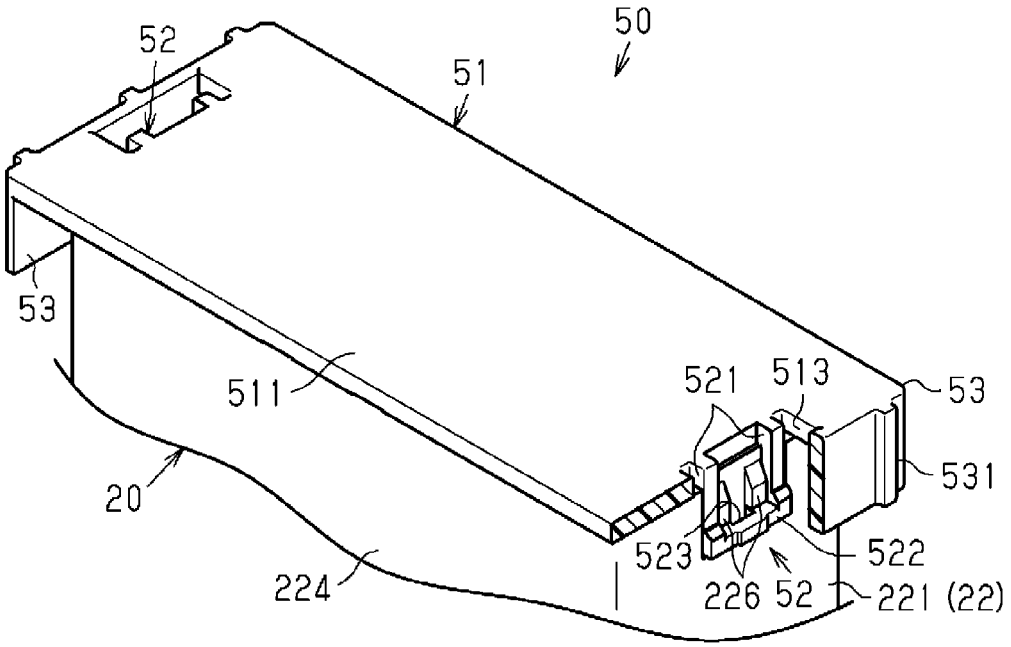
FIG. 4 is a perspective view of the terminal and the cap with a partial configuration shown in section.
Figure 5A:
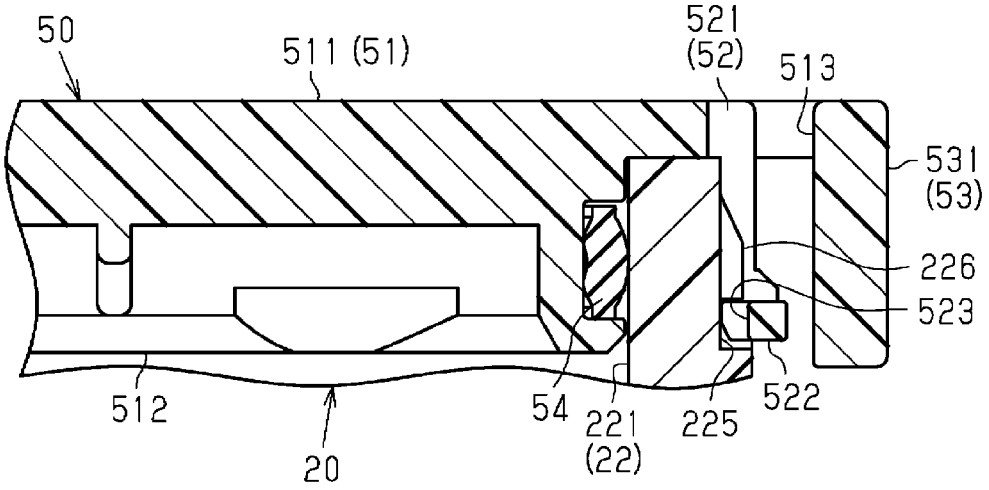
FIG. 5A is a section of the terminal block having the cap mounted thereon and FIG. 5B is a section of the terminal block in removing the cap.

Thereafter, the worker mounts the cap 50 on the housing 22. Particularly, as shown in FIGS. 4 and 5A, the worker locks the locking portions 52 of the cap 50 to the projections 226 of the housing 22 by resiliently deforming the locking portions 52 of the cap 50. Finally, the worker fixes the shield shell 40 to the terminal block 20 to cover the terminal block 20 and the connector 30. In this way, power can be supplied from the power supply device to the equipment while suppressing the leakage of electromagnetic noise from the terminal block 20.

Functions and effects of this embodiment are described.

(1) As shown in FIGS. 4 and 5A, the cap 50 includes the protection walls 53 for covering the locking portions 52. Thus, with the cap 50 mounted on the housing 22, it is made difficult for the worker's hand, the tool and the like to touch the locking portions 52 and for external matters such as flying stones during the travel of a vehicle to collide with the locking portions 52. Therefore, unexpected removal of the cap 50 from the housing 22 can be suppressed.

(2) In the cap 50, the base ends of the locking portions 52 and the base ends of the protection walls 53 are connected via the extending portion 511. Thus, an external force acting on the protection wall 53 is less likely to be transmitted to the locking portion 52. Therefore, it is possible to suppress the removal of the cap 50 from the housing 22 as a result of a displacement of the locking portion 52 due to the external force acting on the protection wall 53.

Figure 5B:
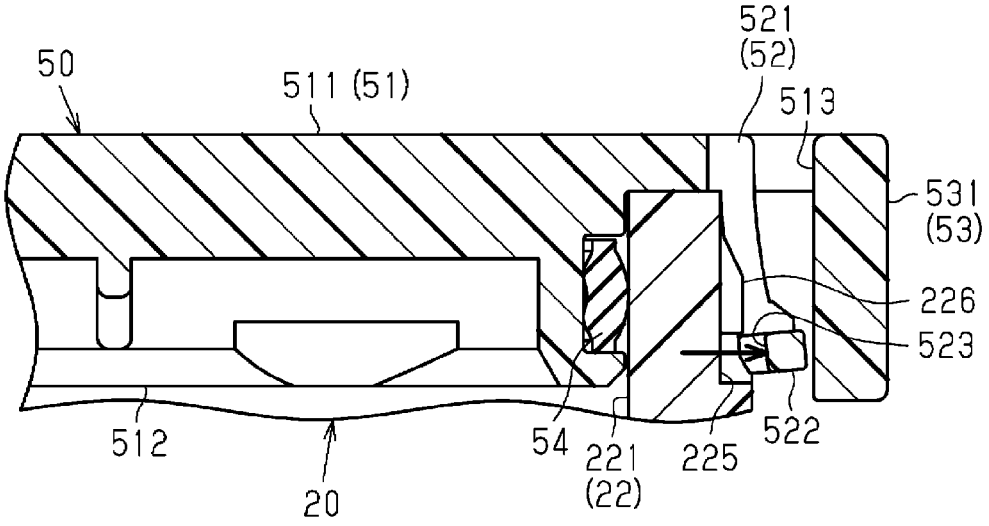

(3) The extending portion 511 of the cap 50 is formed with the through holes 513 communicating with the spaces between the locking portions 52 and the protection walls 53. Thus, as shown by a thick-line arrow in FIG. 5B, the worker can apply an external force to the locking portion 52 (recessed groove 523) via the through hole 513. That is, the worker can remove the cap 50 mounted on the housing 22.

(4) Since the protection wall 53 is provided with the reinforcing ribs 531, the strength of the protection wall 53 can be enhanced.

Note that the above embodiment can be modified and carried out as follows. The above embodiment and the following modifications can be carried out in combination with each other without technical contradiction.

Although the terminal block 20 includes the housing 22 in the above embodiment, the connector 30 may have a configuration equivalent to the housing 22. In this case, the cap 50 is mounted on the connector 30.

Although the cap 50 to be mounted on the housing 22 covering the connected parts of the device-side terminals 23 of the terminal block 20 and the wire-side terminals 31 of the connector 30 has been described in the above embodiment, the cap 50 may be mounted on a housing covering connected parts of device-side terminals of a first connector and wire-side terminals of a second connector.

The protection walls 53 may be thicker than the locking portions 52. According to this, the strength of the protection walls 53 is enhanced.

The shapes of the locking portions 52 of the cap 50 and the projections 226 of the housing 22 may be changed as appropriate. In particular, the locking portions 52 and the projections 226 may be so shaped that the cap 50 is mountable on the housing 22 by the resilient deformation of at least either the locking portions 52 or the projections 226.

The cap 50 may be so configured that the locking portions 52 are partially broken when the cap 50 is removed from the housing 22. According to this configuration, since a new cap 50 is constantly mounted on the housing 22, it is suppressed that the cap 50 deteriorated by being removed from the housing 22 is remounted on the housing 22.

It would be apparent to a person skilled in the art that the present invention may be embodied in other specific forms without departing from the technical idea thereof. For example, some of components described in the embodiment (or one or more modes thereof) may be omitted or several components may be combined. The scope of the present invention should be determined, with reference to accompanying claims, along with the full scope of equivalents to which such claims are entitled.

LIST OF REFERENCE NUMERALS

10 . . . connection device, 20 . . . terminal block, 21 . . . base plate, 22 . . . housing, 221 . . . first wall portion, 222 . . . second wall portion, 223 . . . third wall portion, 224 . . . fourth wall portion, 225 . . . recess, 226 . . . projection, 227 . . . first opening, 228 . . . second opening, 23 . . . device-side terminal, 30 . . . connector, 31 . . . wire-side terminal, 32 . . . protecting portion, 40 . . . shield shell, 41 . . . first shell, 42 . . . second shell, 50 . . . cap, 51 . . . cap body, 511 . . . extending portion, 512 . . . peripheral wall, 513 . . . through hole, 52 . . . locking portion, 521 . . . projecting piece, 522 . . . coupling portion, 523 . . . recessed groove, 53 . . . protection wall, 531 . . . reinforcing rib, 54 . . . sealing member, CS . . . case, SP . . . accommodation space, WR . . . wire

What is claimed is:

1. A cap to be mounted on a housing for accommodating a device-side terminal connected to equipment and a wire-side terminal connected to a wire, the housing being formed with an opening for exposing a connected part of the device-side terminal and the wire-side terminal, comprising:

a cap body for closing the opening of the housing;

a locking portion to be locked to an outer side surface of the housing; and a protection wall for covering the locking portion while being spaced apart from the locking portion, wherein:

the cap body includes an extending portion extending in a direction intersecting a mounting direction on the housing, and the locking portion and the protection wall are integrally formed to the extending portion and extend from the extending portion the locking portion includes:

a plurality of projecting pieces extending in a thickness direction of the extending portion;

a coupling portion coupling each end of the plurality of projecting pieces; and a groove disposed in an inner surface of the coupling portion.

2. The cap of claim 1, wherein the extending portion is formed with a through hole communicating with a space between the locking portion and the protection wall.

3. The cap of claim 1, wherein the protection wall is provided with a reinforcing rib.

4. The cap of claim 1, wherein an outer surface of the coupling portion faces the protection wall, and the inner surface of the coupling portion is disposed to opposite the outer surface of the coupling portion.

5. A connection device, comprising:

the cap of claim 1; and a terminal block including the housing formed with the opening, the cap being mounted on the terminal block to close the opening.

6. The connection device of claim 5, wherein the housing comprises a plurality of projections to be locked to the locking portion, wherein the groove faces a space between the plurality of projections.

* * * * *